US009126780B2

(12) United States Patent
Mimoto et al.

(10) Patent No.: US 9,126,780 B2
(45) Date of Patent: Sep. 8, 2015

(54) TRANSPORT APPARATUS AND IMAGE RECORDING APPARATUS

(71) Applicant: Brother Kogyo Kabushiki Kaisha, Nagoya (JP)

(72) Inventors: Masao Mimoto, Nagoya (JP); Iwane Sano, Obu (JP); Yasuhiro Ota, Yatomi (JP); Keisuke Wakakusa, Nagoya (JP); Jie Xiu, Nagoya (JP); Noriyuki Kawamata, Nagoya (JP); Shingo Ito, Kasugai (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/073,761

(22) Filed: Nov. 6, 2013

(65) Prior Publication Data

US 2014/0232059 A1 Aug. 21, 2014

(30) Foreign Application Priority Data

Feb. 18, 2013 (JP) ..... 2013-029338

(51) Int. Cl.
*B65H 3/06* (2006.01)
*B65H 5/06* (2006.01)

(52) U.S. Cl.
CPC ..... *B65H 3/0684* (2013.01); *B65H 5/062* (2013.01); *B65H 2402/30* (2013.01); *B65H 2402/40* (2013.01); *B65H 2402/52* (2013.01); *B65H 2402/521* (2013.01); *B65H 2402/522* (2013.01); *B65H 2402/53* (2013.01); *B65H 2402/531* (2013.01); *B65H 2402/64* (2013.01); *B65H 2404/17* (2013.01); *B65H 2404/172* (2013.01); *B65H 2404/174* (2013.01); *B65H 2404/6111* (2013.01); *B65H 2801/21* (2013.01)

(58) Field of Classification Search
CPC ..... B65H 2402/521; B65H 2402/52; B65H 2402/522; B65H 2402/53; B65H 2402/531; B65H 2404/17; B65H 2404/174; B65H 2404/172
USPC ..... 271/109
See application file for complete search history.

(56) References Cited

U.S. PATENT DOCUMENTS 5,044,800 A * 9/1991 Rosenthal ..... 400/660
6,467,965 B1 * 10/2002 Wyer ..... 384/295

(Continued)

FOREIGN PATENT DOCUMENTS

JP H09-221246 A 8/1997
JP 2000-072273 A 3/2000

(Continued)

*Primary Examiner* — Howard Sanders
(74) *Attorney, Agent, or Firm* — Merchant & Gould PC

(57) ABSTRACT

A transport apparatus includes a transport roller having a first supported portion and a second supported portion at positions separated in a first direction, and configured to abut against a sheet, rotate in a second direction about a rotation axis extending in the first direction, and transport the sheet; a first support member configured to rotatably support the transport roller, the first support member having a first receiving portion which is in the form of a circular arc and configured to abut against a portion in a circumferential direction of an outer periphery of the first supported portion; and a second support member configured to rotatably support the transport roller, the second support member having a second receiving portion which is in the form of a circular arc and configured to abut against a portion in a circumferential direction of an outer periphery of the second supported portion.

14 Claims, 10 Drawing Sheets

(56) References Cited

U.S. PATENT DOCUMENTS

| | | | | |
|---|---|---|---|---|
| 6,488,276 | B2 * | 12/2002 | Sheng et al. | 271/18 |
| 2007/0194523 | A1 | 8/2007 | Yamaguchi | |
| 2010/0206687 | A1 * | 8/2010 | Saito et al. | 193/37 |
| 2012/0140012 | A1 | 6/2012 | Saito et al. | |

FOREIGN PATENT DOCUMENTS

| | | | |
|---|---|---|---|
| JP | 2007-217152 | A | 8/2007 |
| JP | 2011-219241 | A | 11/2011 |
| JP | 2012-024929 | A | 2/2012 |
| JP | 2012-121647 | A | 6/2012 |

* cited by examiner

TRANSPORT APPARATUS AND IMAGE RECORDING APPARATUS

CROSS REFERENCE TO RELATED APPLICATION

The present application claims priority from Japanese Patent Application No. 2013-029338, filed on Feb. 18, 2013, the disclosure of which is incorporated herein by reference in its entirety.

BACKGROUND OF THE INVENTION

1. Field of the Invention

The present invention relates to a transport apparatus which transports a sheet, and an image recording apparatus.

2. Description of the Related Art

An image recording apparatus which records an image on a paper transported by a transport roller has hitherto been known. The conventional image recording apparatus includes a transport roller which transports a paper, and a recording unit which records an image on the paper transported by the transport roller.

In the image recording apparatus having the abovementioned arrangement, the transport roller is rotatably supported by a bearing. Concretely, the transport roller is fitted from a radial direction into a U-shaped bearing opening upward.

SUMMARY OF THE INVENTION

However, as the transport roller moves in the radial direction at an interior of the bearing due to an external force exerted to the transport roller at the time of operating the image recording apparatus, a problem that an accuracy of transporting the paper is degraded occurs.

The present invention has been made in view of the abovementioned problem, and an object of the present invention is to provide a transport apparatus having a transport roller in which the degradation of the accuracy of transporting is suppressed, and an image recording apparatus which includes the transport apparatus.

According to an aspect of the present invention, there is provided a transport apparatus including: a transport roller having a first supported portion and a second supported portion at positions separated in a first direction, and configured to abut against a sheet, rotate in a second direction about a rotation axis extending in the first direction, and transport the sheet; a first support member configured to rotatably support the transport roller, the first support member having a first receiving portion which is in the form of a circular arc and configured to abut against a portion in a circumferential direction of an outer periphery of the first supported portion; and a second support member configured to rotatably support the transport roller, the second support member having a second receiving portion which is in the form of a circular arc and configured to abut against a portion in a circumferential direction of an outer periphery of the second supported portion, wherein when viewed from one end in the first direction of the transport roller, one end of the first receiving portion on a downstream side in the second direction and one end of the second receiving portion on a downstream side in the second direction are positioned at different positions in the second direction, or the other end of the first receiving portion on an upstream side in the second direction and the other end of the second receiving portion on an upstream side in the second direction are positioned at different positions in the second direction.

As in the abovementioned arrangement, since at least one of the one end portions of the first receiving portion and the second receiving portion respectively, and the other end portions of the first receiving portion and the second receiving portion are positioned at different positions in the second direction when viewed from one end in the first direction of the transport roller, it is possible to reduce an area in the circumferential direction of the transport roller, which is not supported by any of the first receiving portion and the second receiving portion. Accordingly, displacement of position in the radial direction of the transport roller which is caused due to the external force exerted during the rotation is suppressed, and as a result, the degradation of the accuracy of transporting is suppressed.

The transport roller may be supported by each receiving portion in a state that bearings are fitted to the transport roller. The first supported portion and the second supported portion in this case refer to the bearings (to be described later) fitted to the transport roller. On the other hand, the transport roller may be supported directly by each receiving portion. In this case, the first supported portion and the second supported portion refer to positions (portions) of the transport roller abutting against the first receiving portion and the second receiving portion respectively.

According to the present invention, since each of the first receiving portion and the second receiving portion has a circular arc shape which is partly open in the circumferential direction, and since the one end portions of the first receiving portion and the second receiving portion or the other end portions of the first receiving portion and the second receiving portion are positioned at different positions in the circumferential direction of the first and second receiving portion, it is possible to achieve a transport apparatus having a transport roller in which the degradation of transport accuracy is suppressed, and an image recording apparatus which includes the transport apparatus.

BRIEF DESCRIPTION OF THE DRAWINGS

FIG. 6A shows an installation process of the bearing, and FIG. 6B shows an installed state of the bearing.

FIG. 7A shows an installation process of the bearing, and FIG. 7B shows an installed state of the bearing.

DETAILED DESCRIPTION OF THE PREFERRED EMBODIMENTS

Figure 1:
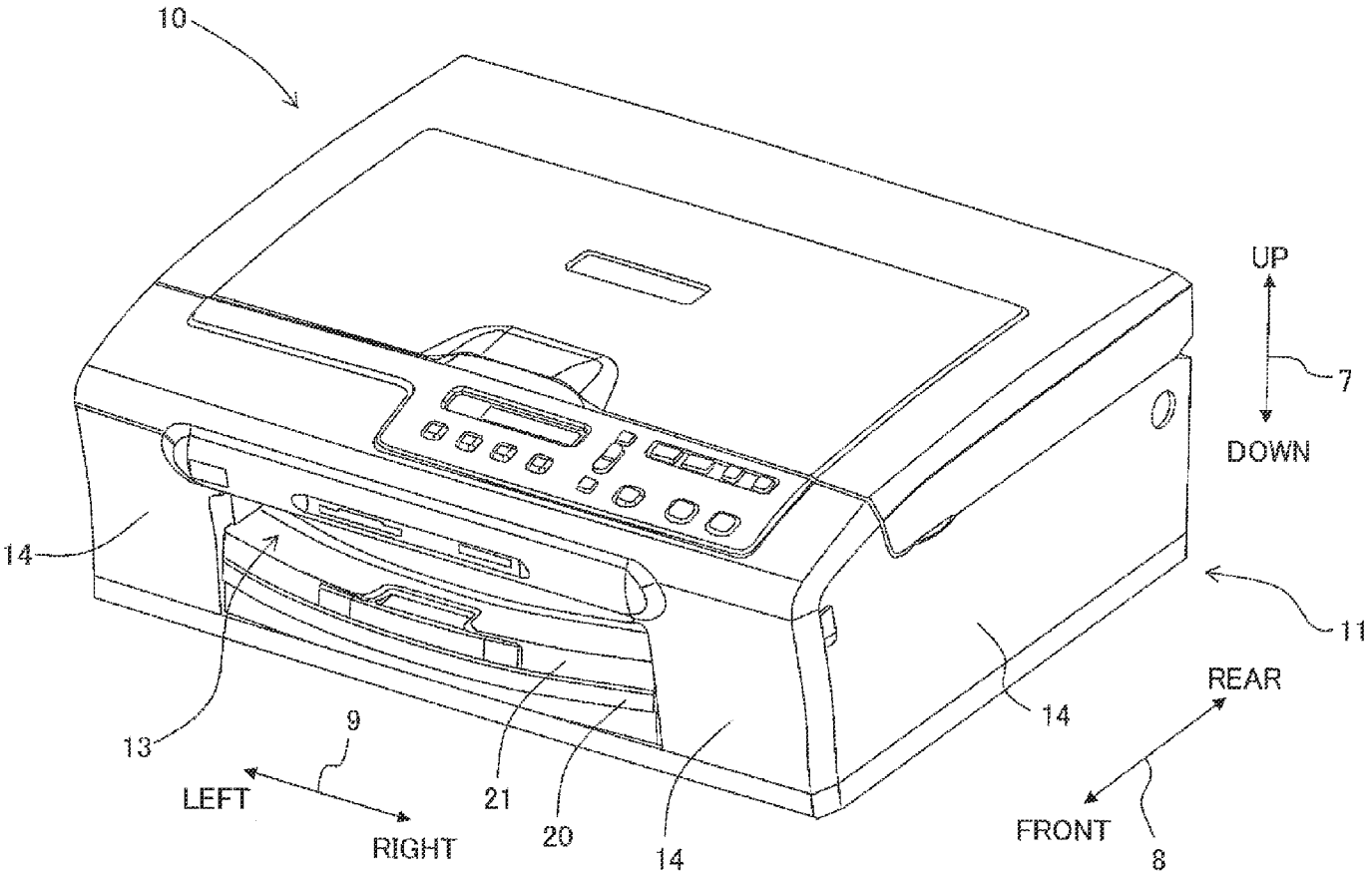
FIG. 1 is a perspective view of a multifunction machine which is an example of an embodiment of the present invention.

An embodiment of the present invention will be described below by referring to the accompanying diagrams. However, the embodiment described below is only an example of the present invention, and it is needless to mention that the embodiment of the present invention can be changed appropriately without departing from the scope of the invention. In the following description, a up-down direction 7 is defined based on a state (state shown in FIG. 1) in which a multifunction machine 10 is installed usably, a front-rear direction 8 is defined assuming that a side on which an opening 13 is provided is a front side (front surface), and a left-right direction 9 is defined while viewing the multifunction machine 10 from the front side (front surface). In the present embodiment, the left-right direction 9 is an example of a first direction, and a direction from a rear side toward a front side is an example of a third direction.

<Overall Structure of Multifunction Machine>

As shown in FIG. 1, the multifunction machine 10 (an example of an image recording apparatus of the present invention) has a substantially thin rectangular parallelepiped shape, and a printer section 11 is provided to a lower portion of the multifunction machine 10. The multifunction machine 10 has various functions such as a facsimile function and a print function. The multifunction machine 10 has a print function of recording an image on one side of a recording paper 12 (an example of a sheet of the present invention, refer to FIG. 2) by an ink-jet method. The multifunction machine 10 may be arranged to record images on both sides of the recording paper 12 respectively. The multifunction machine 10 is provided with a transport apparatus. The transport apparatus is an apparatus which transports the recording paper 12 at an interior of the multifunction machine 10. The transport apparatus includes a transport roller 52, bearings 70, 80, and 90, side frames 120 and 130, and a motor frame 140, that will be described later.

As shown in FIG. 1, an opening 13 is formed in a front surface of the printer section 11. A paper feeding tray 20 which is capable of accommodating recording papers 12 of various sizes, is provided to the printer section 11 to be insertable and extractable in the front-rear direction 8 through the opening 13. A discharge tray 21 is stacked on the paper feeding tray 20 and is moved along with the paper feeding tray 20. The discharge tray 21 supports the recording paper 12 discharged by a pair of discharge rollers 61 that will be described later, upon having an image recorded thereon by a recording section 24 that will be described later.

Figure 2:
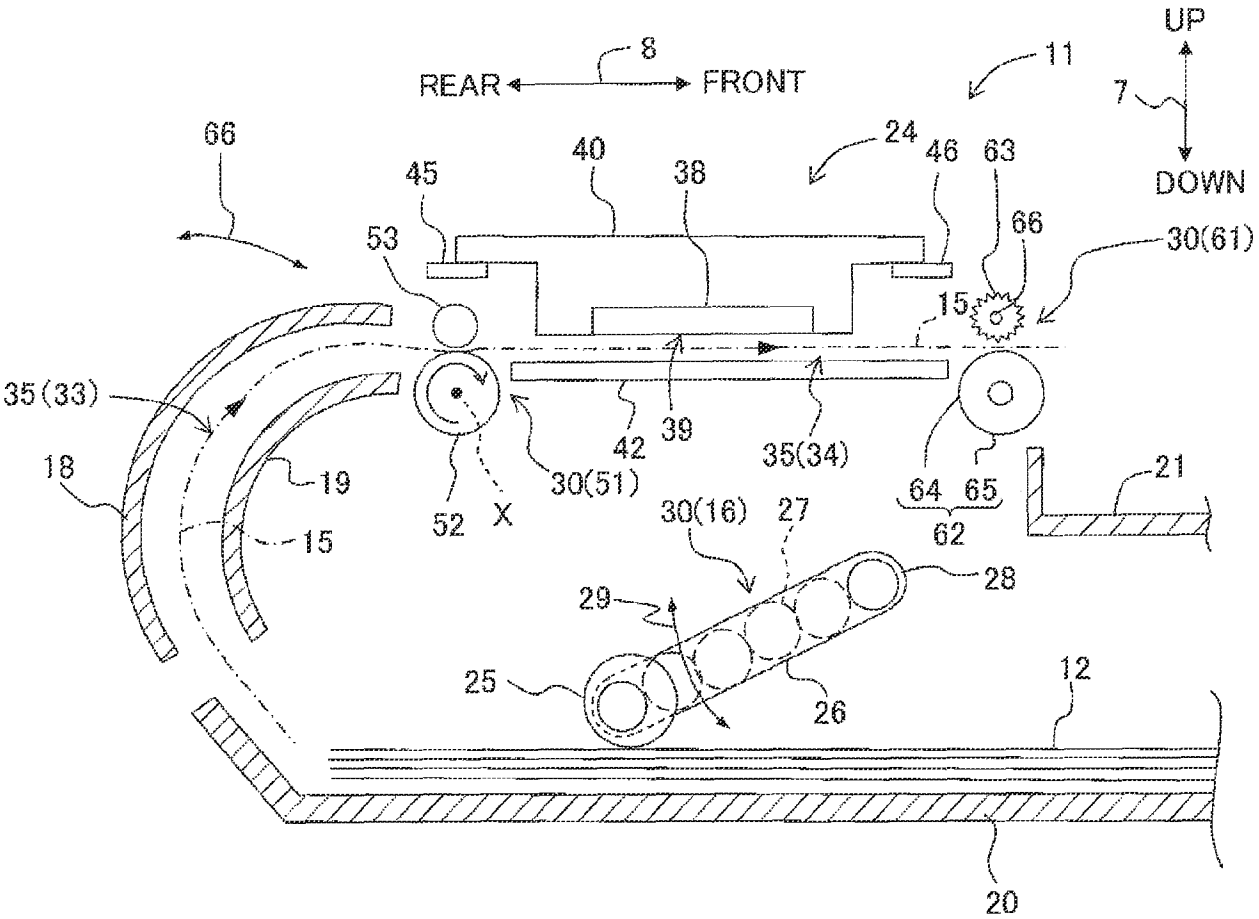
FIG. 2 is a longitudinal sectional view showing schematically an internal structure of a printer section.

The printer section 11 includes a base member 100 (refer to FIG. 3), and an outer cover 14 which covers the base member 100 from an upper side. Moreover, a (paper) feeding section 16, a pair of transport rollers 51, the recording section 24, the pair of discharge rollers 61, and a platen 42, are provided at an interior of the printer section 11 as shown in FIG. 2. The base member 100 supports the feeding section 16, the pair of transport rollers 51, the recording section 24, the pair of discharge rollers 61, the platen 42, and the side frames 120 and 130, and is covered by the outer cover 14.

The feeding section 16 picks up the recording paper 12 from the feeding tray 20, and feeds to a transport path 35. The pair of transport rollers 51 transports the recording paper 12 fed to the transport path 35 by the feeding section 16, to a downstream side in a transport direction 15. The recording section 24 records an image by jetting ink droplets on the recording paper 12 that has been transported by the pair of transport rollers 51. The pair of discharge rollers 61 discharges the recording paper 12 having an image recorded thereon by the recording section 24, to the discharge tray 21. The platen 42 supports from a lower side the recording paper 12 that is transported by the pair of transport rollers 51.

<Transport Path>

As shown in FIG. 2, the transport path 35 extends from a rear end portion of the feeding tray 20. The transport path 35 includes a curved transport path 33 and a linear transport path 34. The curved transport path 33 extends while being curved so that a rear side of the printer section 11 is an outer side of the curve and a front side of the printer section 11 is an inner side of the curve. The linear transport, path 34 extends in the front-rear direction 8. The recording paper 12 supported by the feeding tray 20 is transported to take a U-turn upward from a lower side through the curved transport path 33, and then, is transported frontward through the linear transport path 34 to the recording section 24. The recording paper 12 subjected to image recording by the recording section 24 is transported further frontward through the linear transport path 34, and is discharged to the discharge tray 21. In other words, the recording paper 12 is transported along the transport direction 15 shown by an alternated dotted and dashed line arrow in FIG. 2.

The curved transport path 33 is formed by an outer-side guide member 18 and an inner-side guide member 19 facing mutually leaving a predetermined distance therebetween. The outer-side guide member 18 forms the outer side of the curve in the curved transport path 33. The inner-side guide member 19 forms the inner side of the curve in the curved transport path 33. The linear transport path 34 is formed by the recording section 24 and the platen 42 facing mutually leaving a predetermine distance therebetween at a position at which the recording section 24 is arranged. In other words, each of the outer-side guide member 18 and the inner-side guide member 19 forms at least a part of the transport path 35.

<Transporting Section>

A transporting section 30 includes the feeding section 16 arranged on an upstream side in the transport direction 15 of the curved transport path 33, the pair of transport rollers 51 arranged on an upstream side in the transport direction 15 of the recording section 24 in the linear transport path 34, and the pair of discharge rollers 61 arranged on a downstream side in the transport direction 15 of the recording section 24 in the linear transport path 34.

<Feeding Section>

The feeding section 16, as shown in FIG. 2, is provided above the feeding tray 20 and below the recording section 24, at the interior of the printer section 11. The feeding section 16 includes a feeding roller 25, a feeding arm 26, and a drive transmission mechanism 27. The feeding roller 25 is rotatably supported by a front-end portion of the feeding arm 26. The feeding arm 26 rotates in a direction of an arrow 29 with a spindle 28 provided to a base-end portion as a center. The feeding roller 25 can abut against and be separated from the feeding tray 20 or the recording paper 12 supported by the feeding tray 20. The feeding roller 25 rotates by a driving force of a transport motor 41 (refer to FIG. 10) transmitted by the drive transmission mechanism 27 in which a plurality of gears are engaged. The feeding roller 25 may be rotated by a driving force from another motor provided separately from the transport motor 41

<Pair of Transport Rollers>

Figure 4:
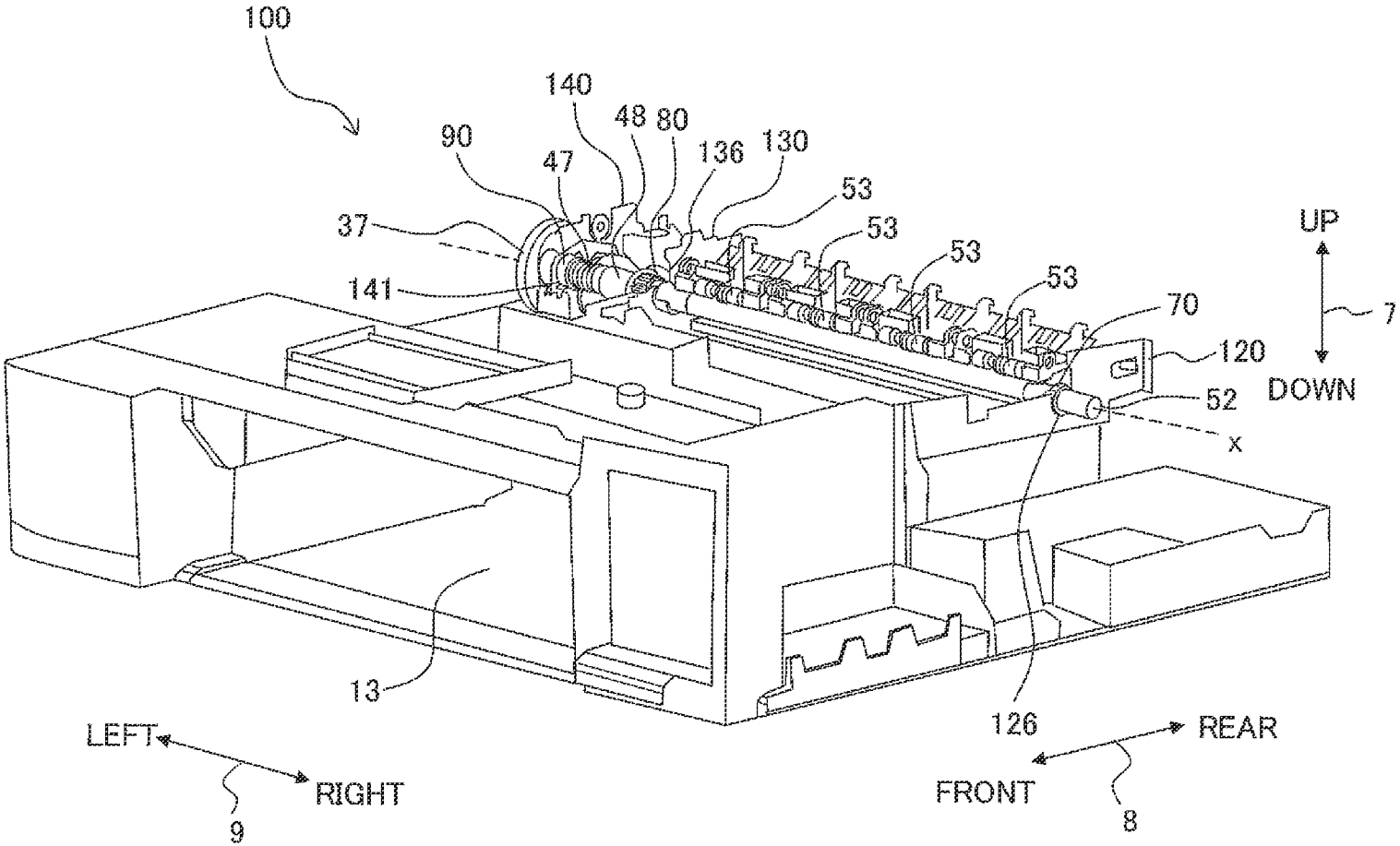
FIG. 4 is a perspective view of the base member which supports the side frames and a transport roller.

The pair of transport rollers 51, as shown in FIG. 2, includes a transport roller 52 and a pinch roller 53 (an example of a driven roller of the present invention). The transport roller 52 in the present embodiment is formed by applying a ceramic coating on an outer periphery of a roller shaft. Moreover, in the present embodiment, a circular-cylindrical shaft (hollow shaft) made of a metal is used as the roller shaft. However, a concrete arrangement of the transport roller 52 is not restricted to the abovementioned arrangement, and a roller may be fitted to a roller shaft, or a solid shaft may be used as the roller shaft. Moreover, the pinch rollers 53 in the present embodiment are provided at a plurality of positions separated in the left-right direction 9 as shown in FIG. 4.

The transport roller 52 in the present embodiment is arranged at a lower side of the linear transport path 34, and abuts against a lower surface of the recording paper 12 which is guided from the curved transport path 33 to the linear transport path 34. The transport roller 52 is rotated with a rotation axis x extending in the left-right direction 9 as a center, by a driving force applied from the transport motor 41 which is capable of driving in a normal direction and a reverse direction. On the other hand, the pinch roller 53 is arranged face-to-face with the transport roller 52 at an upper side of the linear transport path 34, and abuts against an upper surface of the recording paper 12. The pinch roller 53 is rotated along with the rotation of the transport roller 52. The transport roller 52 and the pinch roller 53 pinch the recording paper 12 in the up-down direction 7 and transport the recording paper 12 in the transport direction 15 in consort.

The transport roller 52 undergoes normal rotation by the driving force applied from the transport motor 41 driving in the normal direction. Here, the normal rotation of the transport roller 52 is a rotation in a direction for transporting the recording paper 12 in the transport direction 15. In other words, in FIG. 2, the normal rotation of the transport roller 52 is a rotation in a clockwise direction (an example of a second direction of the present invention), and the normal rotation of the pinch roller 53 is a counterclockwise rotation. On the other hand, the transport roller 52 rotates in a reverse direction by the driving force applied from the transport motor 41 driving in the reverse direction. The reverse rotation of the transport roller 52 is a rotation in direction for transporting the recording paper 12 in a direction opposite to the transport direction 15. In other words, in FIG. 2, the reverse rotation of the transport roller 52 is the counterclockwise rotation, and the reverse rotation of the pinch roller 53 is the clockwise rotation.

<Pair of Discharge Rollers>

The pair of discharge rollers 61, as shown in FIG. 2, includes a discharge roller 62 and a spur 63. The discharge roller 62 in the present embodiment is arranged at a lower side of the linear transport path 34, and abuts against the lower surface of the recording paper 12 which is transported through the linear transport path 34. The discharge roller 62 includes a shaft 64 which rotates by the driving force applied from the transport motor 41, and a roller 65 which rotates integrally with the shaft 64 by being fitted to the shaft 64. On the other hand, the spur 63 is arranged face-to-face with the discharge roller 62 at an upper side of the linear transport path 34, and abuts against the upper surface of the recording paper 12. The spur 63 is fitted to a shaft 66, and is rotated along with the rotation of the discharge roller 62. The discharge roller 62 and the spur 63 pinch the recording paper 12 in the up-down direction 7 and transport the recording paper 12 in the transport direction 15 in consort.

The discharge roller 62 undergoes normal rotation by the driving force applied from the transport motor 41 driving in the normal direction. Here, the normal rotation of the discharge roller 62 is a rotation in the direction for transporting the recording paper 12 in the transport direction 15. In other words, in FIG. 2, the normal rotation of the discharge roller 62 is a clockwise rotation, and the normal rotation of the spur 63 is a counterclockwise rotation. On the other hand, the discharge roller 62 rotates in a reverse (opposite) direction by the driving force applied from the transport motor 41 driving in the reverse direction. The reverse rotation of the discharge roller 62 is a rotation in direction for transporting the recording paper 12 in a direction opposite to the transport direction 15. In other words, in FIG. 2, the reverse rotation of the discharge roller 62 is the counterclockwise rotation, and the reverse rotation of the spur 63 is the clockwise rotation.

<Platen>

The platen 42, as shown in FIG. 2, is provided at a position on a lower side of the linear transport path 34, and between the pair of transport rollers 51 and the pair of discharge rollers 61, or in other words, at a position on a downstream side in the transport direction 15 of the pair of transport rollers 51 and on the upstream side in the transport direction 15 of the pair of discharge rollers 61. The platen 42 is a member which is arranged face-to-face with the recording section 24 in the up-down direction 7, and which supports from the lower site the recording paper 12 transporter in the linear transport path 34.

<Recording Section>

As shown in FIG. 2, the recording section 24 is arranged at a position at an upper side of the linear transport path 34 to face the platen 42 in the up-down direction 7. The recording section 24 includes a carriage 40 and a recording head 38. The carriage 40 is supported by two guide rails 45 and 46. The two guide rails 45 and 46 are arranged at a distance in the front-rear direction 8, and each of the guide rails 45 and 46 extends in the left-right direction 9. The carriage 40 is arranged to spread across the two guide rails 45 and 46, and reciprocates in the left-right direction 9 which is the main scanning direction, along the two guide rails 45 and 46. The recording head 38 is installed on the carriage 40. The recording head 38 jets an ink supplied from an ink cartridge (not shown in the diagram) from a nozzle 39 which is provided in a lower surface. In other words, in the process of moving the carriage 40 in the left-right direction 9, by jetting ink droplets from the nozzle 39 of the recording head 38 toward the platen 42, an image is recorded on the upper surface of the recording paper 12 supported by the platen 42.

<Base Member>

Figure 3:
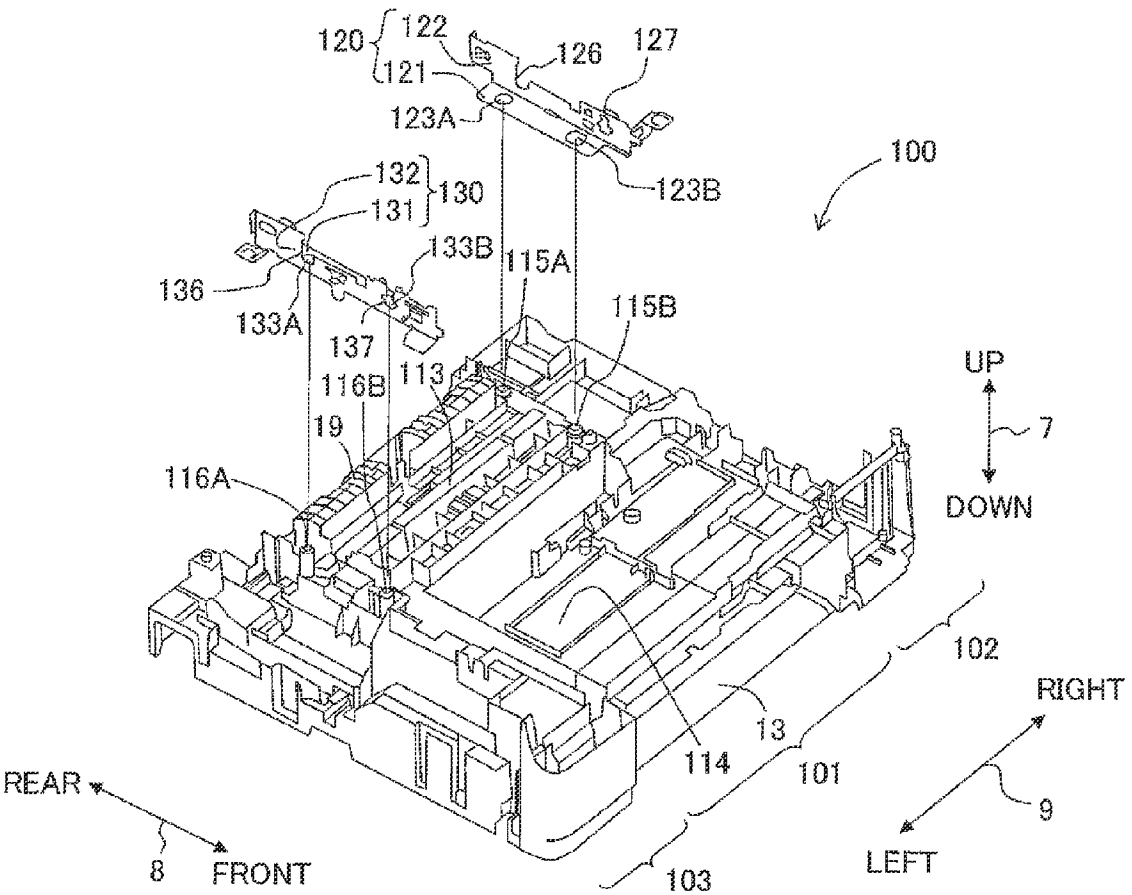
FIG. 3 is an exploded perspective view of a base member and side frames.

The base member 100, as shown in FIG. 3, includes a center base 101 which is positioned at a central portion in the left-right direction 9, and side bases 102 and 103 which are adjacent to the center base 101 in the left-right direction 9. The side base 102 is provided to be adjacent to a right side of the center base 101. The side base 103 is provided to be adjacent to a left side of the center base 101. In other words, the side bases 102 and 103 are provided at positions separated in the left-right direction 9. Moreover, the center base 101 is positioned between the side bases 102 and 103 in the left-right, direction 9. The base member 100 in the present embodiment is formed integrally of a resin material.

The center base 101 has a main wall 113 which is positioned at a rear side in the front-rear direction 8, and a main wall 114 which is positioned at a front side in the front-rear direction 8. The main walls 113 and 114 extend in the front-rear direction 8 and the left-right direction 9, between the side bases 102 and 103. On the other hand, the main walls 113 and 114 are separated mutually in the front-rear direction 8. The main wall 113 supports components such as the feeding section 16, the recording section 24, the pair of transport rollers 51, the pair of discharge rollers 61, and the platen 42. The main wall 114 supports a control substrate (not shown in the diagram) which controls an operation of the multifunction machine 10.

As shown in FIG. 3, protrusions 115A, 115B, 116A, and 116B are provided to two end portions of an upper surface of the main wall 113 in the left-right direction 9. The protrusions 115A and 115B are provided to be separated in the front-rear direction 8 at a right end of the upper surface of the main wall 113. The protrusions 116A and 116B are provided to be separated in the front-rear direction 8 at a left end on the upper surface of the main wall 113. Moreover, a screw hole in which a screw (an example of a fastener member) is to be screwed is formed at a substantial center of each of the protrusions 115A, 115B, 116A, and 116B.

The inner-side guide member 19 is provided at an end portion on the rear side of the main wall 113 in the front-rear direction 8 (in other words, at an end portion of an upstream side in the transport direction 15). Moreover, the recording paper 12 which has been supported by the feeding tray 20 is guided from a lower surface of the main wall 113 to an upper surface side of the main wall 113 by the inner-side guide member 19. Furthermore, the recording paper 12 is guided to a front side in the front-rear direction 8 along an upper surface of the main wall 113 and a lower surface of the main wall 114. In other words, the curved transport path 33 is curved from a lower surface side of the main wall 113 to the upper surface side of the main wall 113, along the end portion of the main wall 113 on the rear side. Moreover, the linear transport path 34 is provided linearly in the front-rear direction 8 on a horizontal surface along the upper surface of the main wall 113 and the lower surface of the main wall 114.

On the upper surface of the main wall 113, as shown in FIG. 3, the side frame 120 (an example of a first support member of the present invention) and the side frame 130 (an example of a third support member of the present invention) are installed at positions separated in the left-right direction 9. The side frames 120 and 130 are formed by carrying out sheet-metal processing on a metal. The side frame 120 is formed by combining a plate shaped base portion 121 and a plate shaped supporting wall 122, such that a cross-sectional shape in a width direction becomes substantially L-shaped. The side frame 130 is formed by combining a base portion 131 in the form of a plate and a supporting wall 132 such that, a cross-sectional shape in a direction of width becomes substantially L-shaped.

The base portion 121 is installed on the upper surface of the main wall 113, with a longitudinal direction thereof in the front-rear direction 8. Through holes 123A and 123B are provided in the base portion 121, at positions separated in the front-rear direction 8. As the side frame 120 is installed on the main wall 113, the protrusions 115A and 115B are inserted into the through holes 123A and 123B. In other words, the protrusions 115A and 115B and the through holes 123A and 123B are provided at positions facing mutually, and position the side frame 120 with respect to the main wall 113 in the front-rear direction 8 and the left-right direction 9. By screwing the screws in the screw holes of the protrusions 115A and 115B in a state that the side frame 120 is installed on the main wall 113, the side frame 120 is fixed to the main wall 113.

The supporting wall 122 is provided as a protrusion at an end portion on one side in the width direction of the base portion 121. In other words, in the state of the side frame 120 installed on the main wall 113, the supporting wall 122 is protruded upward, and extends in the front-rear direction 8. Receiving portions 126 and 127 penetrating the supporting wall 122 in a thickness direction are provided to the supporting wall 122, at positions separated in the longitudinal direction of the side frame 120. An arrangement of the side frame 130 is same as the side frame 120. In other words, through holes 133A and 133B are formed in the base portion 131. Moreover, receiving portions 136 and 137 are provided to the supporting wall 132.

In a state that the side frames 120 and 130 are installed on the main wall 113, the supporting walls 122 and 132 are facing mutually in the left-right direction 9. More elaborately, with respect to the font-rear direction 8, the receiving portions 126 and 136 are facing mutually, and the receiving portions 127 and 137 are facing mutually. Moreover, the receiving portions 126 and 136 support the bearings 70 and 80 which rotatably support the shaft of the transport roller 52. Moreover, the receiving portions 127 and 137 support a bearing (not shown in the diagram) which rotatably supports the shaft 64 of the discharge roller 62. The receiving portion 126 is an example of a first receiving portion of the present invention, and the receiving portion 136 is an example of a third receiving portion of the present invention.

Furthermore, as shown in FIG. 4, the base member 100 supports the motor frame 140 (an example of a second support member of the present invention) at a left side of the side frame 130. The motor frame 140 supports the transport motor 41 (refer to FIG. 10). A receiving portion 141 (an example of a second receiving portion of the present invention) penetrating the motor frame 140 in a thickness direction is formed in the motor frame 140. The motor frame 140 is a member in the form of a plate erected upward from the base member 100 and extending in the front-rear direction 8. In other words, the supporting walls 122 and 132 of the side frames 120 and 130, and the motor frame 140 are arranged to be substantially parallel in the left-right direction 9. The transport path 35 is provided between the side frames 120 and 130 in the left-right direction 9. In other words, the side frames 120 and 130 are positioned at two ends of the transport path 35 in the left-right direction.

Figure 5A:
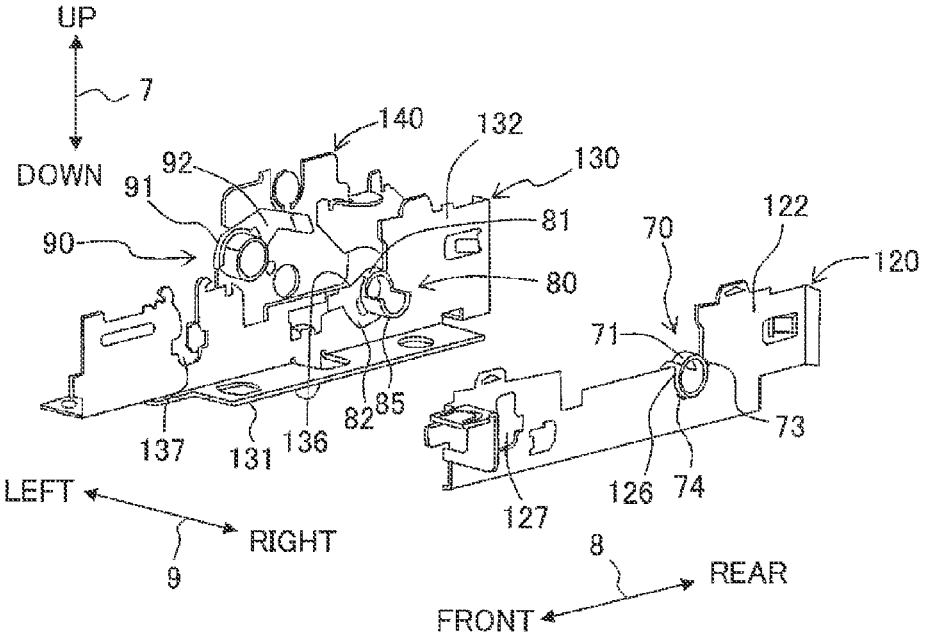
FIG. 5A and FIG. 5B are perspective views of a motor frame and the side frames in a state that bearings are installed.
Figure 5B:
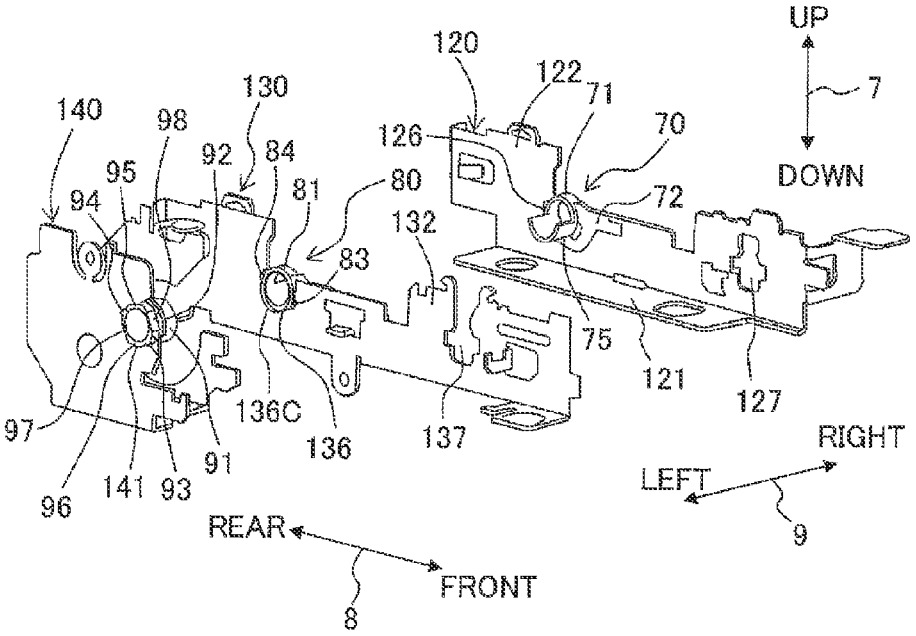

The bearings 70, 80, and 90 are fitted to the transport roller 52 as shown in FIG. 4, at positions separated in an axial direction (the left-right direction 9 in FIG. 4). The bearings 70 and 80 are fitted to the transport rollers 52 at positions corresponding to the receiving portions 126 and 136 of the side frames 120 and 130. The bearing 90 is fitted to the transport roller 52 at a position corresponding to the receiving portion 141 of the motor frame 140. As shown in FIG. 5A and FIG. 5B, the bearing 70 (an example of a first supported portion of the present invention) is supported by the receiving portion 126 of the side frame 120, the bearing 80 (an example of a third supported portion of the present invention) is supported by the receiving portion 136 of the side frame 130, and the bearing 90 (an example of a second supported portion of the present invention) is supported by the receiving portion 141 of the motor frame 140.

The bearing 70, as shown in FIG. 5A and FIG. 5B, includes a tubular portion 71, a flange portion 72, protrusions 73 and 74, and a supporting portion 75. Similarly, the bearing 80 includes a tubular portion 81, a flange portion 82, protrusions 83 and 84, and a supporting portion 85.

The tubular portion 81 has a circular cylindrical shape, and is fitted to the shaft of the transport roller 52. Moreover, an inner diameter of the tubular portion 81 is slightly larger than a diameter of the shaft of the transport roller 52 such that the bearing 80 is movable in an axial direction of the transport roller 52. The flange portion 82 is a plate shaped member spread outward in a radial direction from at least a portion in a circumferential direction, at one end in an axial direction of the tubular portion 81 (right end in the present embodiment). The protrusions 83 and 84 protrude outward in the radial direction from the other end in the axial direction (left end in the present embodiment) of the tubular portion 81. The protrusions 83 and 84 in the present embodiment are provided by displacing the phases by approximately 180° in the circumferential direction. The supporting portion 85 has a circular arc shaped cross-sectional shape in the radial direction, and is protruded in an axial direction from one end in the axial direction of the tubular portion 81.

On the other hand, the receiving portion 136 of the side frame 130 which supports the bearing 80, in FIG. 6 in other words, when viewed from one end in the axial direction of the transport roller 52), has a circular arc shape with one end 136A in the circumferential direction and the other end 136B separated from the one end 136A in the circumferential direction. In other words, a portion of the receiving portion 136 between the one end 136A and the other end 136B is open. A linear distance between points connecting the one end 136A and the other end 136B is longer than the diameter of the shaft of the transport roller 52, and is shorter than an outer diameter of the tubular portion 81. An area between the one end 136A and the other end 136B of the receiving portion 136 is to be referred to as an "open area". Moreover, a notch 136C is provided in the receiving portion 136. The notch 136C is provided on a side opposite to the open area with respect to a center of the receiving portion 136. Moreover, the notch 136C is set to be of a size to allow the protrusion 83 to pass through when the bearing 80 fitted to the shaft of the transport roller 52 is slid in the axial direction.

Figure 6A:
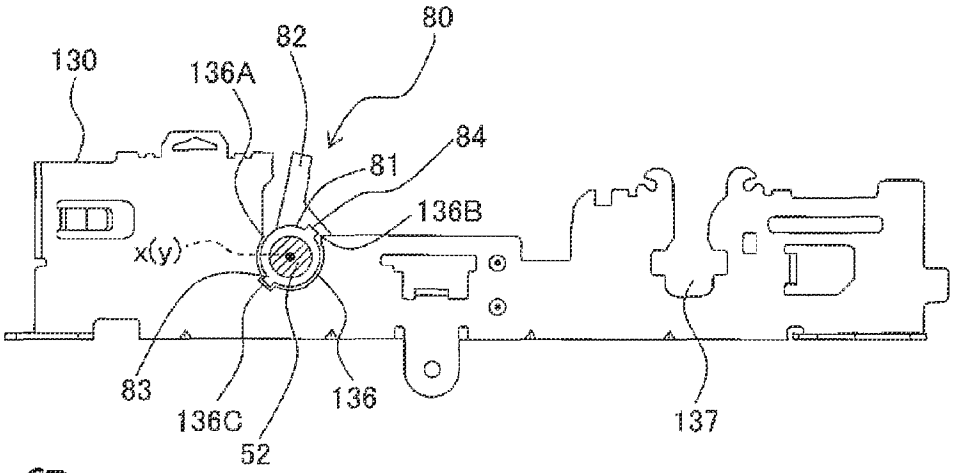
FIG. 6A and FIG. 6B are side views of the side frame, where
Figure 6B:
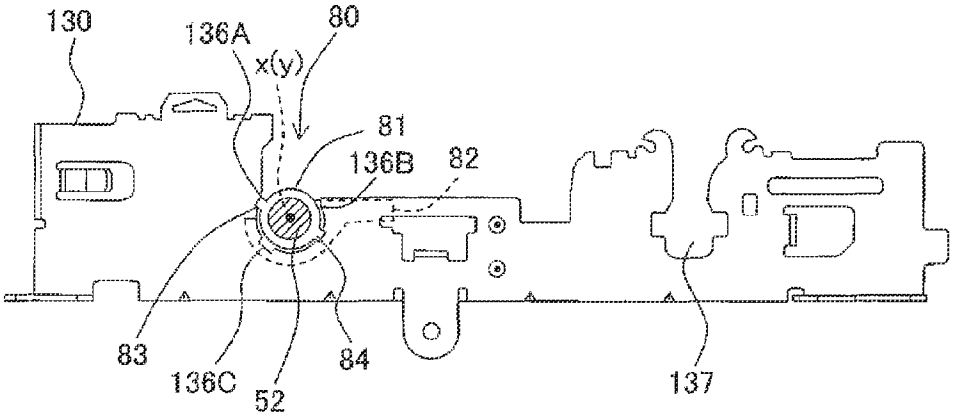

The bearing 80 having the abovementioned arrangement is installed in the receiving portion 136 of the side frame 130 by the following procedure. Firstly, in a state that the bearing 80 fitted to the shaft of the transport roller 52 is displaced rightward of a position corresponding to the receiving portion 136 of the side frame 130, the shaft of the transport roller 52 is inserted into the receiving portion 136 from the radial direction through the open area. Next, as shown in FIG. 6A, in a state that phases of the protrusion 83 of the bearing 80 and the notch 136C of the receiving portion 136 are matched, and phases of the protrusion 84 and the opening area matched in the circumferential direction, the bearing 80 is moved leftward along the shaft of the transport roller 52. Next, at a position where the tubular portion 81 abuts against the receiving portion 136, the bearing 80 is rotated in the circumferential direction (clockwise rotation in an example in FIG. 6) as shown in FIG. 6B.

Accordingly, a portion of an outer periphery of the tubular portion 81 abuts against the receiving portion 136. Moreover, the flange portion 82 abuts against a right surface of the supporting wall 132 as shown in FIG. 5A. Accordingly, the leftward movement of the bearing 80 is regulated. Moreover, the protrusions 83 and 84 abut against a left surface of the supporting wall 132 as shown in FIG. 5B. At this time, positions in the circumferential direction of the protrusions 83 and 84, and the notch 136C and the open area are displaced. Accordingly, the rightward movement of the bearing 80 is regulated. Furthermore, the supporting portion 85 supports the shall of the transport roller 52 from a lower side in the radial direction.

A shape of each component of the bearing 70 is same as a shape of each component of the bearing 80. Installation positions for the flange portion 72, the protrusions 73 and 74, and the supporting portion 75 with respect to the tubular portion 71 are reverse of installation positions of the respective components of the bearing 80. Moreover, a shape of the receiving portion 126 of the side frame 120 is same as a shape of the receiving portion 136 of the side frame 130. In other words, a procedure for installing the bearing 70 in the receiving portion 126 corresponds to a procedure in which the left-right direction 9 is reversed in the abovementioned procedure for installing the bearing 80 in the receiving portion 136.

The bearing 90, as shown in FIG. 5A and FIG. 5B, includes a tubular portion 91, a flange portion 92, and protrusions 93 and 94. The tubular portion 91 has a circular cylindrical shape, and is fitted to the shaft of the transport roller 52. The flange portion 92 is a plate shaped member spread outward in a radial direction from at least a portion in a circumferential direction of the tubular portion 91, at a substantial central portion in the axial direction of the tubular portion 91. The protrusions 93 and 94 protrude outward in the radial direction from one end in the axial direction of the tubular portion 91 (left end in the present embodiment). The protrusions 93 and 94 in the present embodiment are provided by displacing the phases by approximately 180° in the circumferential direction. The flange portion 92 and the protrusions 93 and 94 are an example of a pair of projections of the present invention, protruding outward in the radial direction from an outer periphery of the tubular portion 91 at positions separated in the radial direction.

Figure 7B:
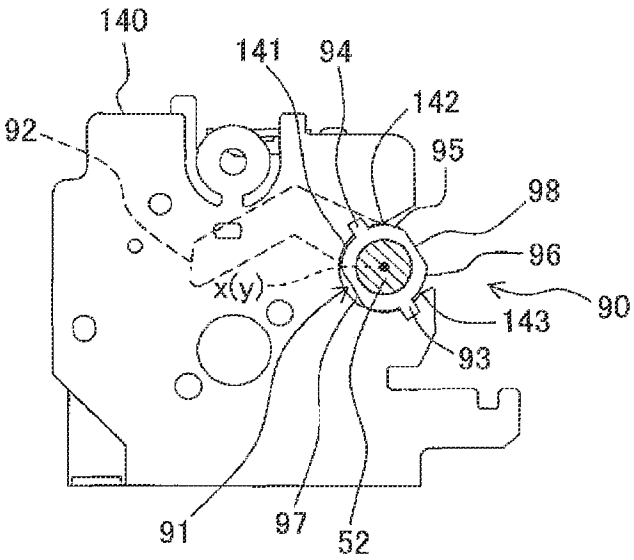
FIG. 7A and FIG. 7B are side views of the motor frame, where
Figure 7A:
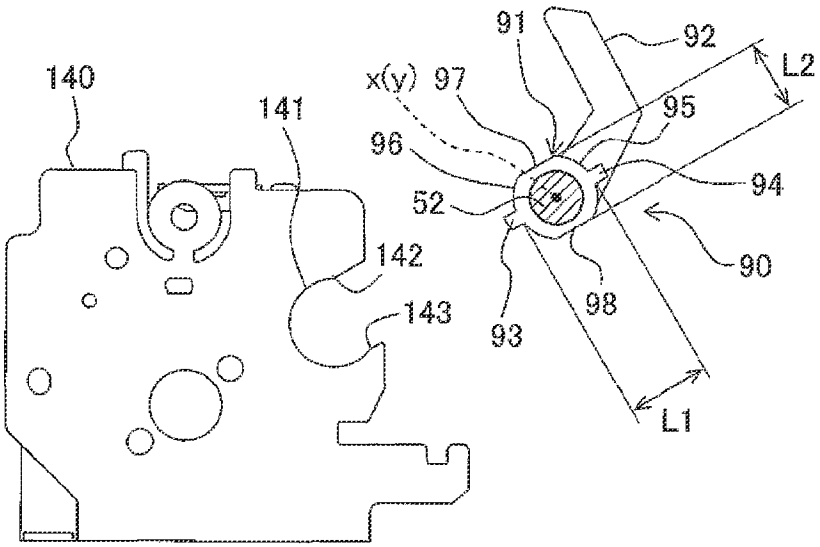

Moreover, as shown in FIG. 7A and FIG. 7B, the outer periphery of the tubular portion 91 is formed by a pair of first peripheral surfaces 95 and 96 and a pair of second peripheral surfaces 97 and 98, between the flange portion 92 and the protrusions 93 and 94. Each of the first peripheral surfaces 95 and 96 has a circular arc shape along the receiving portion 141 of the motor frame 140, and the first peripheral surfaces are facing mutually. The second peripheral surfaces 97 and 98 are facing mutually between the first peripheral surfaces 95 and 96. Moreover, the second peripheral surface 97 connects an end portion on one side of the first peripheral surface 95 and an end portion on the other side of the second peripheral surface 96. The second peripheral surface 98 connects an end portion on the other side of the first peripheral surface 95 and an end portion on one side of the first peripheral surface 96.

On the other hand, the receiving portion 141 of the motor frame 140 which supports the bearing 90, in FIG. 7 (in other words, when viewed from one end in the axial direction of the transport roller 52), has a circular arc shape with one end 142 in the circumferential direction and the other end 143 separated from the one end 142 in the circumferential direction. In other words, a portion of the receiving portion between the one end 142 and the other end 143 is open. A linear distance between points connecting the one end 142 and the other end 143 is shorter than a distance L1 in a direction in which the pair of the first peripheral surfaces 95 and 96 are facing, and is longer than a distance L2 in a direction in which the pair of the second peripheral surfaces 97 and 98 are facing. An area between the one end 142 and the other end 143 of the receiving portion 141 is referred to as an "open area".

The bearing 90 having the abovementioned arrangement is installed in the receiving portion 141 of the motor frame 140 by the following procedure. Firstly, as shown in FIG. 7A, in a state that the second peripheral surfaces 97 and 98 of the bearing 90 fitted in the shaft of the transport roller 52 are parallel to a direction of insertion into the receiving portion 141, the shaft of the transport roller is inserted into the receiving portion 141 from the radial direction through the open area. Next, as shown in FIG. 7B, the bearing 90 is rotated in the circumferential direction (counterclockwise rotation in an example FIG. 7A and FIG. 7B) till the pair of the first peripheral surfaces 95 and 96 abuts against the receiving portion 141.

Accordingly, a part of an outer periphery of the tubular portion 91 (more elaborately, the pair of the first peripheral surfaces 95 and 96) abuts against the receiving portion 141. Moreover, the flange portion 92 abuts against a right surface of the motor frame 140 as shown in FIG. 5A. Accordingly, the leftward movement of the bearing 90 is regulated. Moreover, the protrusions 93 and 94 abut against a left surface of the motor frame 140 as shown in FIG. 5B. At this time, positions in the circumferential direction of the protrusions 93 and 94 and the open area are displaced. Accordingly, the rightward movement of the bearing 90 is regulated.

In the present embodiment, phases of the open areas of the receiving portions 126 and 136 in the circumferential direction are same. More elaborately, one end of the receiving portion 126 in the circumferential direction and one end of the receiving portion 136 in the circumferential direction are at the same position in the circumferential direction, and the other end of the receiving portion 126 and the other end of the receiving portion 136 are at the same position in the circumferential direction. On the other hand, phases of the open areas of the receiving portions 126 and 136 and a phase of the open area of the receiving portion 141 are different in the circumferential direction. Positional relation of the one end 136A of the receiving portion 136, the one end 142 of the receiving portion 141, the other end 136B of the receiving portion 136, and the other end 143 of the receiving portion 141 will be described below by referring to FIG. 8A and FIG. 8B. Since the receiving portions 126 and 136 are at the same phase, the description of the receiving portion 126 will be omitted, and only the receiving portions 136 and 141 will be described below.

Figure 8B:
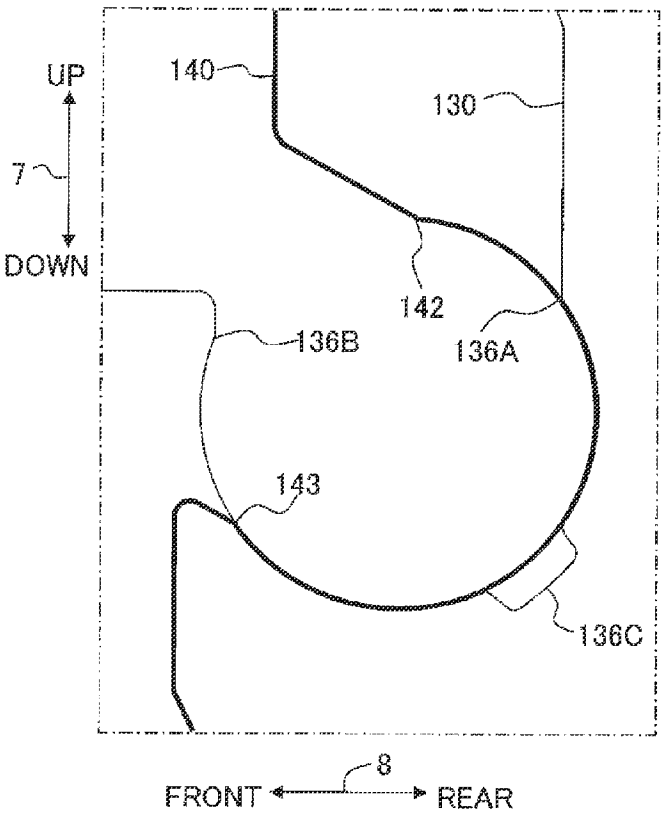
FIG. 8A and FIG. 8B are diagrams showing phases in a circumferential direction of receiving portions.
Figure 8A:
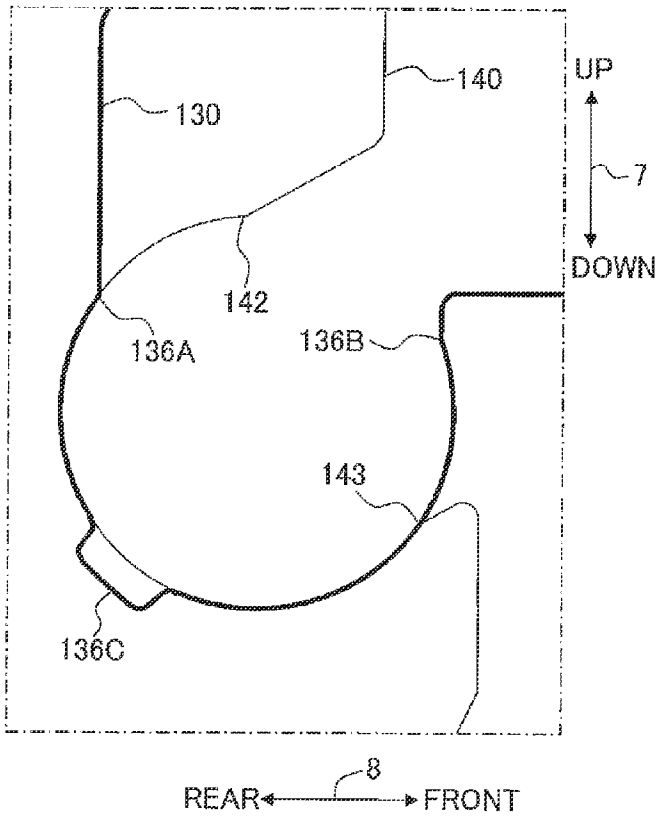

To start with, FIG. 8A is an enlarged view of the receiving portions 136 and 141 when the side frame 130 and the motor frame 140 are viewed from a left side (namely, when viewed from a left end in the left-right direction 9 of the transport roller 52), and the motor frame 140 positioned at near side is indicated by a thin line, and the side frame 130 positioned at far side is indicated by a thick line. On the other hand, FIG. 8B is an enlarged view of the receiving portions 136 and 141 when the side frame 130 and the motor frame 140 are viewed from a right side (namely, when viewed from a right end in the left-right direction 9 of the transport roller 52), and the side frame 130 positioned at near side is indicated by a thin line, and the motor frame 140 positioned at far side is indicated by a thin line. Moreover, in FIG. 8A, an end portion in a clockwise direction of an outline of the receiving portion is referred to as "one end of the receiving portion", and an end portion in a counterclockwise direction of the outline of the receiving portion is referred to as "the other end of the receiving portion".

As shown in FIG. 8A and FIG. 8B, the one end 136A of the receiving portion 136 and the one end 142 of the receiving portion 141 are displaced (positioned at different positions) in the circumferential direction. More elaborately, the one end 142 of the receiving portion 141 is at a position advanced in the clockwise direction in FIG. 8A (counterclockwise direction in FIG. 8B) with respect to the one end 136A of the receiving portion 136. In other words, between the one end 142 of the receiving portion 141 and the one end 136A of the receiving portion 136, the shaft of the transport roller 52 is supported by the receiving portion 141, but not supported by the receiving portion 136.

Similarly, the other end 136B of the receiving portion 136 and the other end 143 of the receiving portion 141 are displaced (positioned at different positions) in the circumferential direction. More elaborately, the other end 136B of the receiving portion 136 is at a position advanced in the counterclockwise direction in FIG. 8A (clockwise direction in FIG. 8B) with respect to the other end 143 of the receiving portion 141. In other words, between the other end 136B of the receiving portion 136 and the other end 143 of the receiving portion 141, the shaft of the transport roller 52 is supported by the receiving portion 136, but not supported by the receiving portion 141.

On the other hand, between the one end 136A of the receiving portion 136 and the other end 143 of the receiving portion 141 (more elaborately, a side including the notch 136C), the shaft of the transport roller 52 is supported by both the receiving portions 136 and 141. In other words, the shaft of the transport roller 52, in the circumferential direction thereof, is divided into an area supported only by the receiving portions 126 and 136, an area supported only by the receiving portion 141, an area supported by all the receiving portions 126, 136, and 141, and an area not supported by any of the receiving portions 126, 136, and 141. As a result, as shown in FIG. 8A and FIG. 8B, an open area when the receiving portions 136 and 141 are overlapped is smaller than each of the open area of the receiving portion 136 and the open area of the receiving portion 141.

Figure 9A:
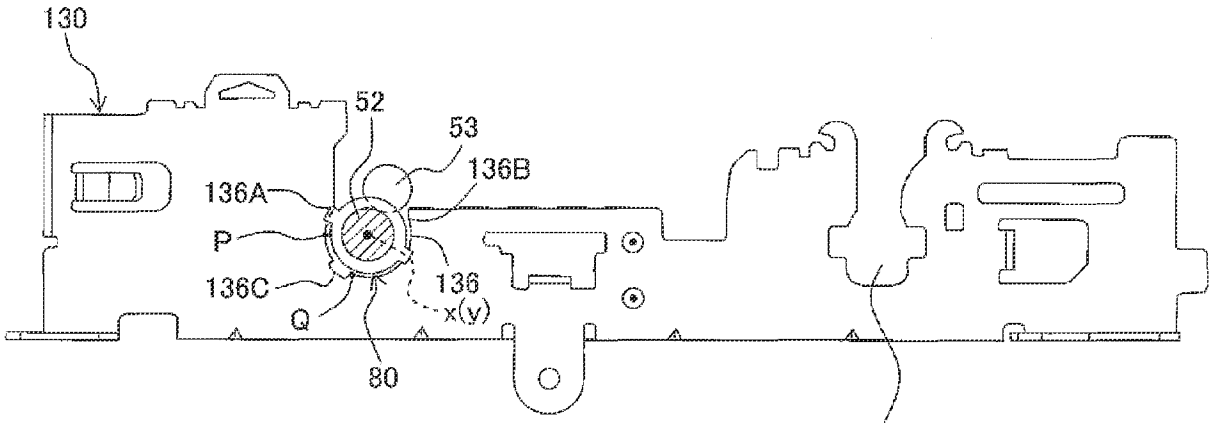
FIG. 9A shows positions P and Q on an outer periphery of the bearing, supported by the receiving portion.

The open area of the receiving portion 136, as shown in FIG. 9A, is formed at an upper side of the shaft of the transport roller 52 (more elaborately, the bearing 80). In other words, the open area of the receiving portion 136 includes an abutting position of the transport roller 52 and the pinch roller 53. On the other hand, the receiving portion 136 abuts against a part of the outer periphery of the bearing 80, in the circumferential direction, including a position P and a position Q indicated in FIG. 9A. The position P is a position on the outer periphery of the bearing 80, on the most upstream side in the transport direction of the recording paper 12. The position P in the present embodiment is a position on a rear side of the bearing 80 in the front-rear direction 8. Moreover, the position Q is a position on the outer periphery of the bearing 80, on a side opposite to the abutting position of the transport roller 52 and the pinch roller 53 with respect to a rotation center of the transport roller 52. The position in the present embodiment is a position on a lower side of the bearing 80 in the up-down direction 7.

Figure 9B:
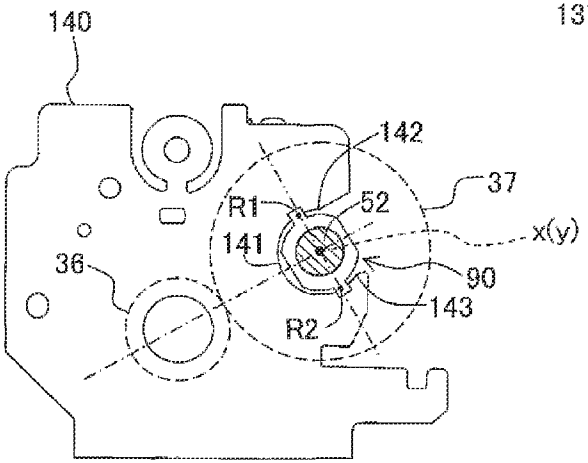
FIG. 9B shows positions R1 and R2 on an outer periphery of the bearing, supported by the receiving portion.

The open area of the receiving portion 141, as shown in FIG. 9B, is formed on an upper side in a frontward direction of the outer periphery of the shaft of the transport roller 52 (more elaborately, the bearing 90). On the other hand, the receiving portion 141 abuts against a part of the outer periphery of the bearing 90, in the circumferential direction, including positions R1 and R2 indicated in FIG. 9B. The positions R1 and R2 are intersections between the outer periphery of the bearing 90 and a straight line (a straight line shown by an alternate long and two short dashes line in FIG. 9B), which passes through a rotation center of the transport roller 52 and which is orthogonal to another straight line (a line shown by an alternate long and short dash line in FIG. 9B) connecting a point at which a first gear 36 and a second gear 37 are engaged and the rotation center y of the transport roller 52. The position R1 in the present embodiment is a position at an upper side in a rearward direction of the bearing 90, and the position R2 in the present embodiment is a position at a lower side in a frontward direction of the bearing 90.

Figure 10:
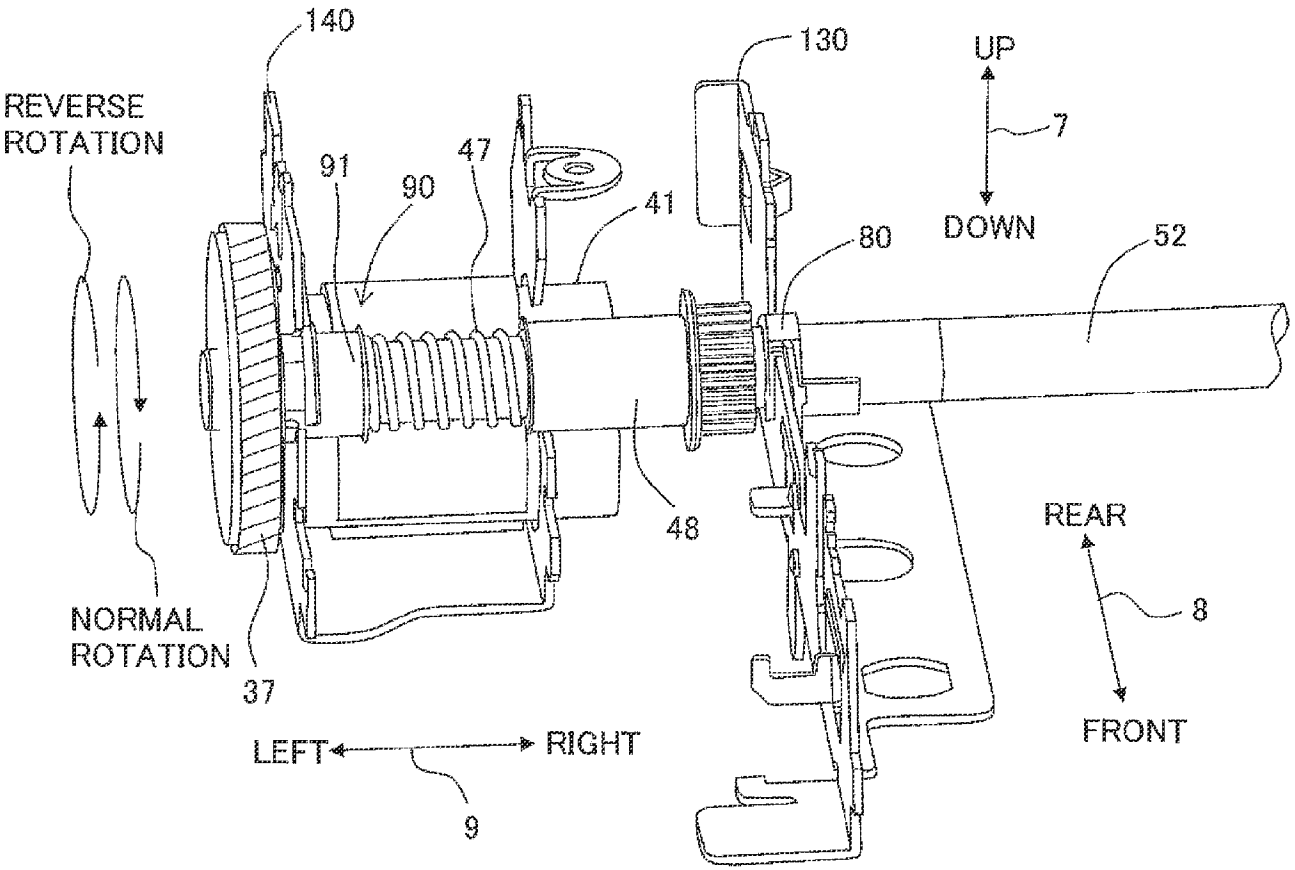
FIG. 10 is an enlarged perspective view of a portion between the side frame and the motor frame.

The first gear 36 is a gear which is fitted to a drive shaft of the transport motor 41, and which rotates integrally with the drive shaft. The second gear 37 is a gear which is fitted to the shaft of the transport roller 52, and which rotates integrally with the shaft of the transport roller 52. Moreover, the first gear 36 and the second gear 37 are engaged mutually. In other words, a driving force of the transport motor 41 is transmitted to the transport roller 52 through the first gear 36 and the second gear 37. Moreover, both the first gear 36 and the second gear 37 are helical gears as shown in FIG. 10. Each tooth of the second gear 37 is inclined such that an end portion (a left end in FIG. 10) on a side farther from the motor frame 140 advances in a direction of the normal rotation with respect to an end portion (a right end in FIG. 10) on a side nearer from the motor frame 140 (in other words, inclined in a direction of inclined lines shown on the second gear 37 in FIG. 10).

Moreover, a coil spring 47 (an example of a bias applying member of the present invention) is fitted on the shaft of the transport roller 52 as shown in FIG. 10. More elaborately, one end of the coil spring 47 (left end in FIG. 10) abuts against an edge surface of the tubular portion 91 of the bearing 90. The other end of the coil spring 47 (right end in FIG. 10) abuts against an edge surface of a fitting member 48 which is fixed by fitting on the shaft of the transport roller 52. Accordingly, the coil spring 47 presses the shaft of the transport roller 52 in a direction of bringing the second gear 37 closer to the motor frame 140 (rightward direction in FIG. 10).

[Action and Effect of the Present Embodiment]

According to the present embodiment, since the positions in the circumferential direction of the one ends 136A and 142 of the receiving portions 136 and 141 have been displaced, and the positions in the circumferential direction of the other ends 136B and 143 of the receiving portions 136 and 141 have been displaced, the open area when the receiving portions 136 and 141 are overlapped becomes smaller than the open area of the receiving portion 136 and the open area of the receiving portion 141 respectively. A relationship between the receiving portion 126 and the receiving portion 141 is the same. As a result, since it is possible to reduce the area which is not supported by any of the receiving portions 126, 136, and 141 in the circumferential direction of the shaft of the transport roller 52, a displacement in the radial direction of the transport roller 52 due to an external force that is exerted during the rotation is suppressed. Accordingly, a degradation of an accuracy of transporting is suppressed even when a light-weight hollow shaft is used as the shaft of the transport roller 52.

On the other hand, the receiving portions 126 and 136 positioned at the two ends of the transport path 35 support the same area in the circumferential direction of the shaft of the transport roller 52. Accordingly, even when a force has acted on the transport roller 52 from a specific direction (such as a force in a direction of pushing up the transport roller 52), since the transport roller 52 moves parallel without being twisted, no adverse effect can be imparted to the transporting of the recording paper 12.

In the present embodiment, an example, in which the bearings 70, 80, 90 fitted to the shaft of the transport roller 52 are supported by the receiving portions 126, 136, and 141 respectively, has been described. However, the present invention is not restricted to such arrangement. For instance, the shaft of the transport roller 52 may be directly supported by the receiving portions 126, 136, and 141. In this case, supported portions refer to positions of the shaft of the transport roller 52 supported by the receiving portions 126, 136, and 141 respectively.

Moreover, the receiving portions 126 and 136 in the present embodiment support the bearings 70 and 80 at the positions P and Q. The position P is a position which receives a reactive force from the recording paper 12 transported in the transport direction 15. The position Q is a position which receives a pressure from the pinch rollers 53. Therefore, by supporting the positions P and Q by the receiving portions 126 and 136 of the side frames 120 and 130 positioned at the two ends of the transport path 35, it is possible to suppress a displacement in the radial direction of the transport roller 52. In a case that the transport roller 52 transports the recording paper 12 in a direction opposite to the transport direction 15, it is desirable to support the bearings 70 and 80 at positions at an opposite side of the position P with respect to the rotation center of the transport roller 52.

Moreover, the receiving portion 141 in the present embodiment supports the bearing 90 at the positions R1 and R2. The positions R1 and R2 are positions of supporting a load applied from the first gear 36 to the second gear 37. Therefore, by supporting the positions R1 and R2 by the receiving portion 141 of the motor frame 140 adjacent to the second gear 37, it is possible to suppress a displacement in the radial direction of the transport roller 52. Combinations of the receiving portions 126, 136, and 141 and the positions P, Q, R1, and R2 supporting the bearings 70, 80, and 90 of the transport roller 52 are not restricted to the combination in the abovementioned example. For instance, all the receiving portions 126, 136, and 141 may support the bearings 70, 80, and 90 at the positions P, Q, R1, and R2.

Moreover, according to the present embodiment, by engaging the first gear 36 and the second gear 37 which are helical gears in the abovementioned direction, when the transport roller 52 undergoes normal rotation, a thrust load in a direction of pressing against the motor frame 140 is applied from the first gear 36 to the second gear 37. As a result, it is possible to position the transport roller 52 in the axial direction in the process of transporting the recording paper 12 in the transport direction 15. Moreover, by using the helical gears, it is possible to drive more silently.

On the other hand, the transport roller 52 according to the present embodiment is not only capable of normal rotation but also capable of reverse rotation. The second gear 37 in this case receives the thrust load in a direction of being pulled away from the motor frame 140, from the first gear 36. Therefore, by applying a bias in a direction opposite to the abovementioned thrust load to the shaft of the transport roller 52 by the coil spring 47, it is possible to suppress the displacement of the transport roller 52 at the time of reverse rotation. For positioning of the transport roller 52 at the time of normal rotation, accuracy higher than the accuracy at the time of reverse rotation is sought. Therefore, the abovementioned combination of the inclination of the teeth of the second gear 37 and the direction of bias applied by the coil spring 47 is desirable.

Moreover, according to the present embodiment, the bearings 70 and 80 have the structure shown in FIG. 6, and the bearing 90 has the structure shown in FIG. 7. However, the structure of the bearings 70, 80, and the structure of the bearing 90 are not restricted to the abovementioned structures. For instance, all the bearings 70, 80, and 90 may have the structure in FIG. 6, or may have the structure in FIG. 7. The structure in FIG. 6 is advantageous from a point that an area of contact of the bearing and the receiving portion becomes large. On the other hand, the structure in FIG. 7 is advantageous from a point that the installation of the bearing becomes easy.

Furthermore, in the abovementioned embodiment, an example of the multifunction machine 10 including the printer section 11 of the ink-jet recording type has been explained as an example of a transport apparatus. However, the present invention is not restricted to the abovementioned multifunction machine 10. The present invention may be applied to a printer of a laser recording type and may be applied to a feeder which transports a document in an image reading apparatus.

What is claimed is:

1. A transport apparatus comprising:

a transport roller having a first supported portion and a second supported portion at positions separated in a first direction, and configured to abut against a sheet, rotate in a second direction about a rotation axis extending in the first direction, and transport the sheet;

a first support member configured to rotatably support the transport roller, the first support member having a first receiving portion which is in the form of a circular arc and configured to abut against a portion in a circumferential direction of an outer periphery of the first supported portion; and a second support member configured to rotatably support the transport roller, the second support member having a second receiving portion which is in the form of a circular arc and configured to abut against a portion in a circumferential direction of an outer periphery of the second supported portion, wherein when viewed from one end in the first direction of the transport roller, one end of the first receiving portion on a downstream side in the second direction and one end of the second receiving portion on a downstream side in the second direction are positioned at different positions in the second direction, or the other end of the first receiving portion on an upstream side in the second direction and the other end of the second receiving portion on an upstream side in the second direction are positioned at different positions in the second direction, wherein the transport roller has a third supported portion between the first supported portion and the second supported portion in the first direction, the transport apparatus further includes a third support member configured to rotatably support the transport roller, the third support member having a third receiving portion which is in the form of a circular arc and configured to abut against a portion in a circumferential direction of an outer periphery of the third supported portion, the transport roller is configured to abut against the sheet between the first support member and the third support member, and the one end of the first receiving portion and one end of the third receiving portion on the downstream side in the second direction are aligned in the second direction, and the other end of the first receiving portion and the other end of the third receiving portion on the upstream side in the second direction are aligned in the second direction.

2. The transport apparatus according to claim 1, wherein the one end of the first receiving portion and the one end of the second receiving portion are positioned at different positions in the second direction, and the other end of the first receiving portion and the other end of the second receiving portion are positioned at different positions in the second direction.

3. The transport apparatus according to claim 1, further comprising a driven roller configured to be pressed against an outer periphery of the transport roller at a position between the first supported portion and the third supported portion and rotate along with the rotation of the transport roller, wherein the first receiving portion is configured to abut against a portion of an outer periphery of the first supported portion on a side opposite to a contact position, at which the transport roller contacts the driven roller, with respect to a rotation center of the transport roller, and the third receiving portion is configured to abut against a portion of an outer periphery of the third supported portion on the side opposite to the contact position with respect to the rotation center of the transport roller.

4. The transport apparatus according to claim 1, wherein the first receiving portion is configured to abut against a portion of an outer periphery of the first supported portion on a most upstream side in a third direction in which the transport roller is configured to transport the sheet, and the third receiving portion is configured to abut against a portion of an outer periphery of the third supported portion on the most upstream side in the third direction.

5. A transport apparatus comprising:

a transport roller having a first supported portion and a second supported portion at positions separated in a first direction, and configured to abut against a sheet, rotate in a second direction about a rotation axis extending in the first direction, and transport the sheet;

a first support member configured to rotatably support the transport roller, the first support member having a first receiving portion which is in the form of a circular arc and configured to abut against a portion in a circumferential direction of an outer periphery of the first supported portion; and a second support member configured to rotatably support the transport roller, the second support member having a second receiving portion which is in the form of a circular arc and configured to abut against a portion in a circumferential direction of an outer periphery of the second supported portion, wherein when viewed from one end in the first direction of the transport roller, one end of the first receiving portion on a downstream side in the second direction and one end of the second receiving portion on a downstream side in the second direction are positioned at different positions in the second direction, or the other end of the first receiving portion on an upstream side in the second direction and the other end of the second receiving portion on an upstream side in the second direction are positioned at different positions in the second direction, wherein a linear distance between the one end of the first receiving portion and the other end of the first receiving portion is longer than a diameter of the transport roller, and a linear distance between the one end of the second receiving portion and the other end of the second receiving portion is longer than the diameter of the transport roller.

6. The transport apparatus according to claim 5, wherein the first supported portion includes:

a cylindrical portion configured to be fitted to the transport roller and to be movable in the first direction;

a flange portion in the form of a plate configured to spread outward in a radial direction of the cylindrical portion from at least a portion of the cylindrical portion in the circumferential direction, at one end of the cylindrical portion in the first direction; and a protrusion configured to protrude outward in the radial direction of the cylindrical portion from the other end of the cylindrical portion in the first direction, a linear distance between the one end of the first receiving position and the other end of the first receiving portion is longer than a diameter of the transport roller and is shorter than a diameter of the cylindrical portion, and the first receiving portion has a notch through which the protrusion is to be passed in the first direction, at a position in the second direction different from a position of the protrusion of the first supported portion attached to the first receiving portion.

7. The transport apparatus according to claim 5, wherein the second supported position includes:

a cylindrical portion configured to be fitted to the transport roller; and a pair of projections configured to protrude outward in the radial direction of the cylindrical position from an outer periphery of the cylindrical portion at positions separated in the first direction, the outer periphery of the cylindrical position between the pair of projections has a pair of first peripheral surfaces which face mutually and each of which has a circular arc shape along the second receiving position, and a pair of second peripheral surfaces which face mutually and which connect end portions of the pair of first peripheral surfaces, and a linear distance between the one end of the second receiving portion and the other end of the second receiving portion is shorter than a distance in a facing direction of the pair of first peripheral surfaces, and is longer than a distance in a facing direction of the pair of second peripheral surfaces.

8. The transport apparatus according to claim 5, wherein the transport roller has a hollow structure.

9. An image recording apparatus comprising:

a transport apparatus as defined in claim 5; and a recording section configured to record an image on the sheet transported by the transport roller.

10. The transport apparatus according to claim 5, wherein a portion between the one end of the first receiving portion and the other end of the first receiving portion is open, and a portion between the one end of the second receiving portion and the other end of the second receiving portion is open.

11. A transport apparatus comprising:

a transport roller having a first supported portion and a second supported portion at positions separated in a first direction, and configured to abut against a sheet, rotate in a second direction about a rotation axis extending in the first direction, and transport the sheet;

a first support member configured to rotatably support the transport roller, the first support member having a first receiving portion which is in the form of a circular arc and configured to abut against a portion in a circumferential direction of an outer periphery of the first supported portion;

a second support member configured to rotatably support the transport roller, the second support member having a second receiving portion which is in the form of a circular arc and configured to abut against a portion in a circumferential direction of an outer periphery of the second supported portion, wherein when viewed from one end in the first direction of the transport roller, one end of the first receiving portion on a downstream side in the second direction and one end of the second receiving portion on a downstream side in the second direction are positioned at different positions in the second direction, or the other end of the first receiving portion on an upstream side in the second direction and the other end of the second receiving portion on an upstream side in the second direction are positioned at different positions in the second direction, a motor;

a first gear configured to be fitted to a drive shaft of the motor and configured to rotate along with the drive shaft; and a second gear configured to be engaged with the first gear and fitted to the transport roller, and configured to rotate along with the transport roller, wherein the first gear and the second gear are arranged adjacent to the second support member in the first direction, and the second receiving portion is configured to abut against a portion of the outer periphery of the second supported portion at which a line passing through the rotation center of the transport roller intersects with the outer periphery of the second supported portion, the line being orthogonal to a line connecting the rotation center of the transport roller and an engaging position of the first gear and the second gear.

12. The transport apparatus according to claim 11, wherein the first gear and the second gear are helical gears, the second gear is configured to perform a normal rotation which rotates the transport roller in the second direction, and each tooth of the second gear is inclined such that an end portion on a side farther from the second support member advances in a direction of the normal rotation than an end portion on a side nearer to the second support member.

13. The transport apparatus according to claim 12, wherein the second gear is configured to perform reverse rotation in which the second gear rotates in a direction opposite to the normal rotation, and the transport apparatus further includes an urging member configured to urge the second gear toward the second support member.

14. A transport apparatus comprising:

a transport roller having a first supported portion and a second supported portion at positions separated in a first direction, and configured to abut against a sheet, rotate in a second direction about a rotation axis extending in the first direction, and transport the sheet;

a first support member configured to rotatably support the transport roller, the first support member having a first receiving portion which is in the form of a circular arc and configured to abut against a portion in a circumferential direction of an outer periphery of the first supported portion; and a second support member configured to rotatably support the transport roller, the second support member having second receiving portion which is in the form of a circular arc and configured to abut against a portion in a circumferential direction of an outer periphery of the second supported portion, wherein when viewed from one end in the first direction of the transport roller, one end of the second receiving portion on an upstream side in the second direction is positioned between one end of the first receiving portion and the other end of the first receiving portion in the second direction, and the other end of the first receiving portion on a downstream side in the second direction is positioned between the one end of the second receiving portion and the other end of the second receiving portion in the second direction.

* * * * *